US007522119B2

(12) United States Patent
Jung et al.

(10) Patent No.: US 7,522,119 B2
(45) Date of Patent: Apr. 21, 2009

(54) MULTIBAND ANTENNA WITH REMOVED COUPLING

(75) Inventors: Chang-won Jung, Yongin-si (KR); Young-eil Kim, Yongin-si (KR); Se-hyun Park, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/606,981

(22) Filed: Dec. 1, 2006

(65) Prior Publication Data

US 2008/0007478 A1 Jan. 10, 2008

(30) Foreign Application Priority Data

Jul. 4, 2006 (KR) ..... 10-2006-0062612

(51) Int. Cl.

| | |
|---|---|
| ***H01Q 1/48*** | (2006.01) |
| ***H01Q 9/04*** | (2006.01) |
| ***H01Q 9/30*** | (2006.01) |
| ***H01Q 9/16*** | (2006.01) |
| ***H01Q 1/38*** | (2006.01) |

(52) U.S. Cl. ..... 343/846; 343/700 MS; 343/825; 343/806; 343/828

(58) Field of Classification Search ..... 343/700 MS, 343/806, 825, 828, 829, 846
See application file for complete search history.

(56) References Cited

U.S. PATENT DOCUMENTS

| | | | | |
|---|---|---|---|---|
| 6,653,986 | B2 * | 11/2003 | Watada et al. | 343/895 |
| 2005/0174294 | A1 | 8/2005 | Peroulis et al. | |
| 2006/0022889 | A1 | 2/2006 | Chiang et al. | |

FOREIGN PATENT DOCUMENTS

| | | | |
|---|---|---|---|
| WO | 01/20718 | A1 | 3/2001 |
| WO | 03/103090 | A1 | 12/2003 |
| WO | 2005/006494 | A1 | 1/2005 |

* cited by examiner

*Primary Examiner*—Michael C Wimer
*Assistant Examiner*—Jennifer F Chang
(74) *Attorney, Agent, or Firm*—Sughrue Mion, PLLC

(57) ABSTRACT

A multiband antenna with removed coupling includes a radiator formed as a meander line bent zigzag several times and having a gap filling part in at least one area between neighboring meander lines. The gap filling part interconnects the neighboring meander lines. The multiband antenna further includes a ground connected with the radiator and at least one switch element mounted in an area along the longitudinal direction of the radiator and configured to alternately short or open an area of the radiator. Accordingly, two different resonance frequencies can be tuned using the single antenna, and the antenna efficiency can be enhanced by removing the coupling between the resonant frequencies that are tuned through the gap filling.

20 Claims, 5 Drawing Sheets

MULTIBAND ANTENNA WITH REMOVED COUPLING

CROSS-REFERENCE TO RELATED APPLICATIONS

This application claims priority from Korean Patent Application No. 10-2006-0062612 filed on Jul. 4, 2006 in the Korean Intellectual Property Office. The priority application is incorporated herein by reference in its entirety.

BACKGROUND OF THE INVENTION

1. Field of the Invention

Apparatuses consistent with the present invention relate to a multiband antenna with removed coupling. More particularly, the present invention relates to a multiband antenna with removed coupling, which can operate in a plurality of service bands and improve antenna efficiency by removing the coupling.

2. Description of the Related Art

With recent on-going developments of various wireless communication services available through wireless terminals, such as GSM, PSC, WLAN, WiBro, and Bluetooth, reconfigurable antennas are required to enjoy the wireless communication services at one wireless terminal.

To this end, antennas with a very wide frequency band covering a plurality of service bands have been developed. However, an antenna operating in the wide frequency band can reduce the antenna size but may cause noise and interference because of unused bands.

Alternatively, multiband antennas operating in double or multiple frequency bands are under development. Among them, a multiband antenna, which is disclosed in U.S. Patent Application Publication No. 2005-0174294, changes the operating frequency of the antenna by loading a series of PIN diodes in a slot line at intervals and electrically adjusting the length of the radiator through on or off of the PIN diodes. However, such a multiband antenna is relatively large because the slot line is used. To prevent this, the antenna line can be bent in a meander line shape. In this case, the resonant frequency of parasitic effects is generated due to the coupling between the meander lines. The parasitic resonant frequency causes the degradation of the antenna efficiency.

Therefore, what is needed is a solution that can reduce the size of the multiband antenna and/or eliminate the parasitic resonant frequency resulting from the coupling between strip lines.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

In one aspect, exemplary embodiments of the present invention provide a multiband antenna with removed coupling, which is a small antenna capable of resonating in multiple service bands and removing the parasitic resonant frequency due to the coupling.

The multiband antenna with removed coupling includes a radiator, which is formed as a meander line bent zigzag several times and includes a gap filling part in at least one area between neighboring meander lines. The gap filling part interconnects the neighboring meander lines. The multiband antenna with removed coupling further includes a ground connected with the radiator and at least one switch element mounted in an area along the longitudinal direction of the radiator and configured to alternately short or open an area of the radiator.

The gap filling part may fill up gaps between the meander lines, excluding a gap between the meander lines where the switch element is mounted.

The length of the gap filling part may be shorter than half of the meander line.

The switch element may be a PIN diode.

The multiband antenna with removed coupling may further include a switch controller which turns on the switch element by applying a voltage above a certain level to the switch element.

When the switch element is turned on, the radiator may operate in a lower frequency band than off state of the switch element. When the switch element is turned off, the radiator may operate in a higher frequency band than the on state of the switch element.

A plurality of switch elements may be loaded at intervals along the longitudinal direction of the radiator.

BRIEF DESCRIPTION OF THE DRAWINGS

These and other aspects of the present invention will become more apparent and more readily appreciated from the following description of exemplary embodiments thereof, with reference to the accompanying drawings, in which:

FIG. 6A shows a radiation pattern of the antenna when the PID diode is turned on.

DETAILED DESCRIPTION OF EXEMPLARY EMBODIMENTS OF THE INVENTION

Figure 1:
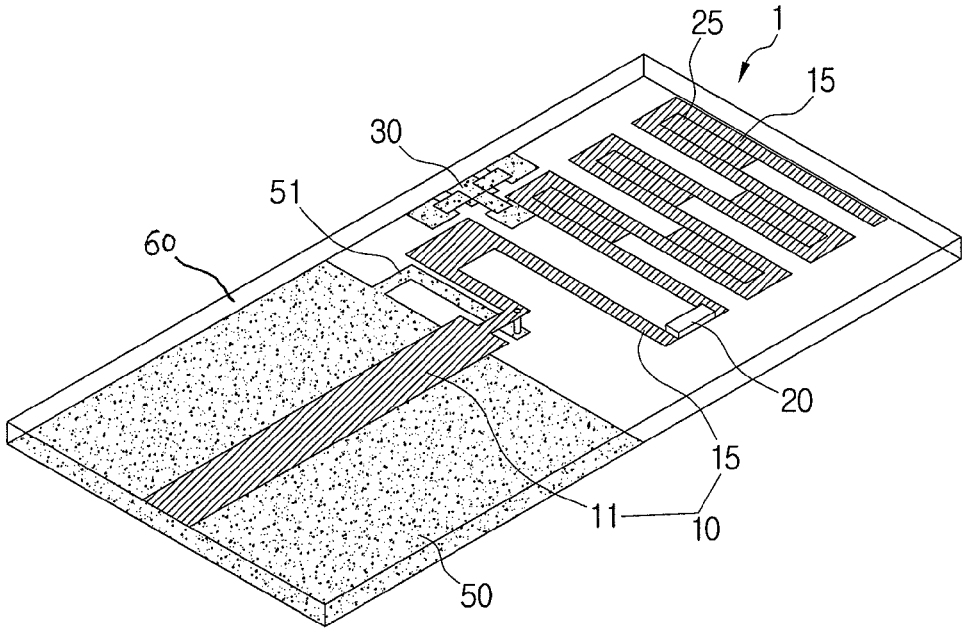
FIG. 1 is a perspective view of a multiband antenna in accordance with an exemplary embodiment of the present invention.

Certain exemplary embodiments of the present invention will now be described in greater detail with reference to the accompanying drawings.

In the following description, the same drawing reference numerals are used to refer to the same elements, even in different drawings. The matters defined in the following description, such as detailed construction and element descriptions, are provided as examples to assist in a comprehensive understanding of the invention. Also, well-known functions or constructions are not described in detail, since they would obscure the invention in unnecessary detail.

Figure 2:
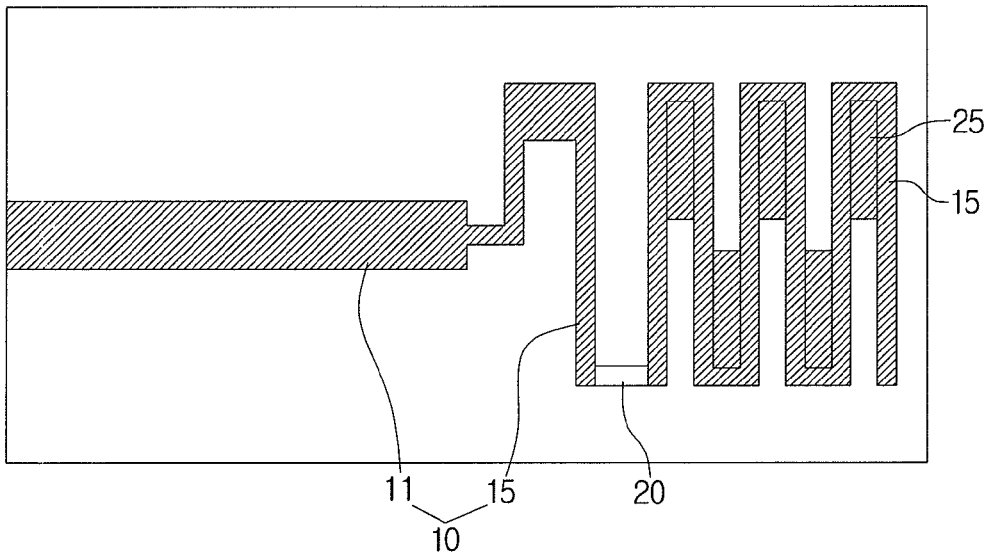
FIG. 2 is a front view of the multiband antenna of FIG. 1.
Figure 3:
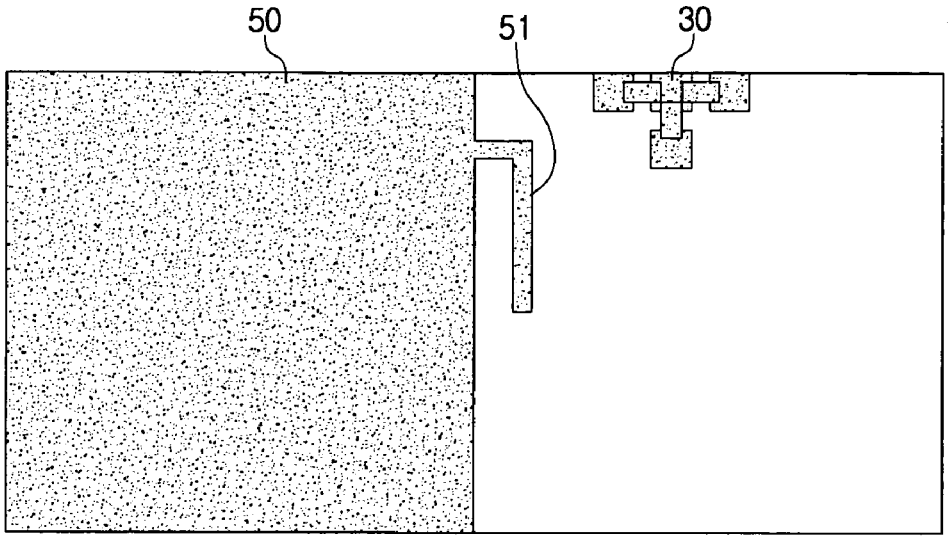
FIG. 3 is a rear view of the multiband antenna of FIG. 1.

FIGS. 1, 2, and 3 are respectively a perspective view, a front view, and a rear view of a wireless terminal antenna according to an exemplary embodiment of the present invention.

The wireless terminal antenna 1 includes a radiator 10 part of which is formed as the meander line, a ground 50, a switch element loaded to the meander line to adjust the length of the radiator 10, and a switch controller 30 which turns the switch element on or off. In this particular embodiment, the switch element is a PIN diode 20.

The ground 50 may be attached to one side of a circuit board 60 and electrically connected with the radiator 10. In this particular embodiment, a match part 51 is formed at the position corresponding to the radiator 10 of the ground 50. The match part 51 is extended from the ground 50 by a certain distance and bent in 'ㄱ'shape. The match part 51 may be electrically connected with the radiator 10 through a via hole 13.

The match part 51 serves to raise the frequency matching by improving the return loss of the antenna 1.

Continuing with the exemplary embodiment shown in FIGS. 1-3, the radiator 10 is attached to the other side of the circuit board 60 as a patch antenna. The radiator 10 includes a meander line part 15 bent several times along the longitudinal direction and a feed part 11 in a straight-band shape. In this embodiment, the length of the feed part 11 is substantially equal to the length of the ground 50 and arranged to correspond to the area of the ground 50.

The meander line part 15 in this exemplary embodiment is extended from the end of the feed part 11 and bent in alternating ("zigzag") directions several times. The end of the meander line part 15 that faces the feed part 11 is electrically connected with the ground 50 through the via hole 13.

In the exemplary embodiment shown in FIGS. 1-3, a gap filling part 25 is formed to the meander line part 15 to fill in gaps between the neighboring meander lines. The gap filling part 25 is formed in the bent area of the meander line and extended from the bent area by a certain distance to interconnect the neighboring meander lines. The length of the gap filling part 25 is preferably, though not necessarily, shorter than half of the meander line. The gap filling part 25 may be formed in the bent area of every meander line, excluding the bent area of the PIN diode 20.

Figure 4:
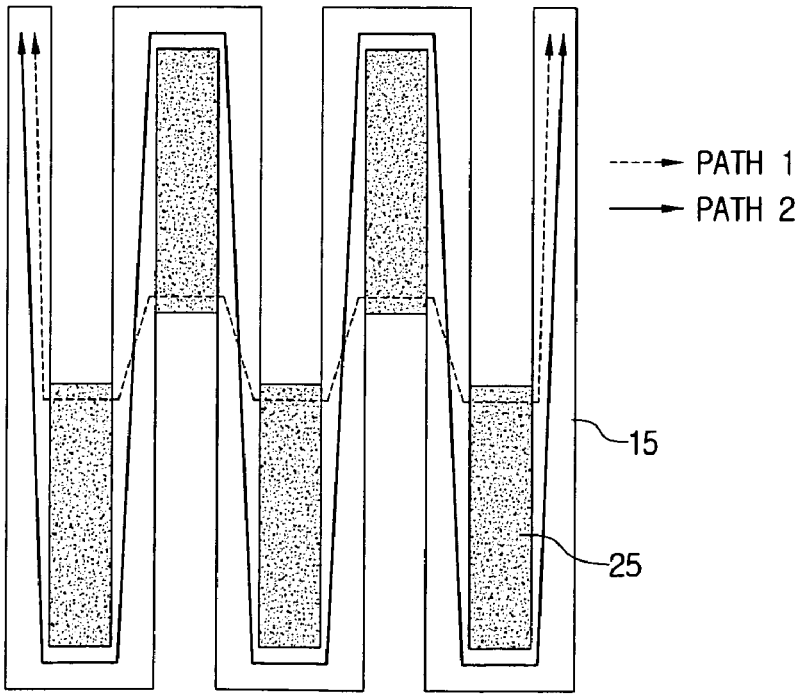
FIG. 4 is a plan view of current paths of the meander line part before and after the generation of the gap filling part.

FIG. 4 is a plan view of current paths of the meander line part 15 before and after the generation of the gap filling part 25.

In FIG. 4, the current path 2 before the gap filling part 25 is generated in the zigzags along the meander line. In this case, since the current flows in the opposite direction along the neighboring meander lines and the current path in the neighboring meander lines is lengthy, the coupling occurs between two operating frequencies. As a result, parasitic operating frequency is generated between two operating frequencies as indicated by the circle in FIG. 5A. The parasitic operating frequency degrades the antenna efficiency.

Referring back to FIG. 4, the current path 1 after the gap filling part 25 follows the gap filling part 25 of the meander line part 15. In this case, as the current flows along ends of the gap filling part 25, the current path along the meander lines is shortened. Thus, the coupling between the currents along the meander lines is removed. Consequently, as shown in FIG. 5B, the parasitic operating frequency is removed from the two operating frequencies. In addition, as one can see, the return loss decreases at the operating frequencies as a result of the improved antenna efficiency that has not been degraded by the parasitic operating frequency.

Figure 5A:
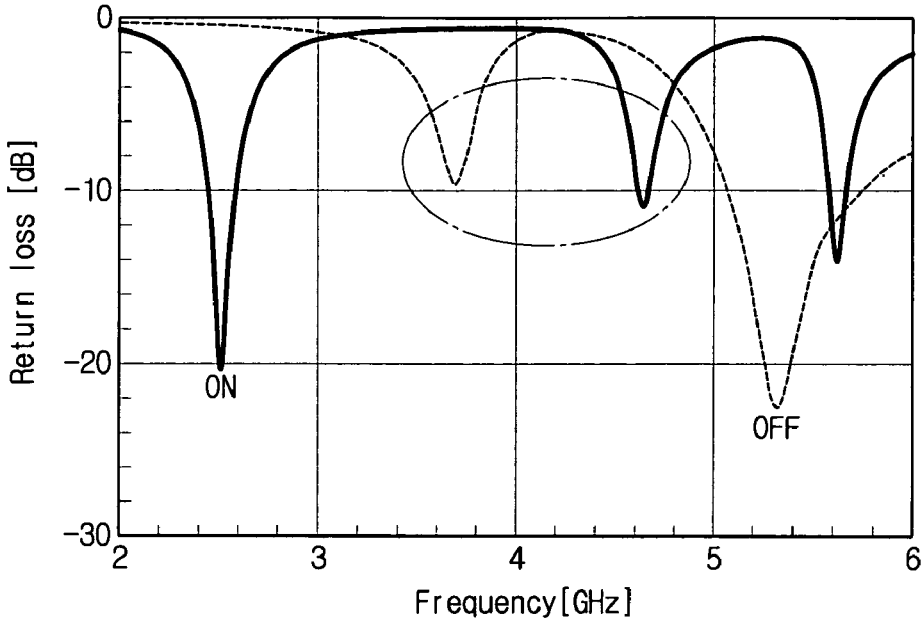
FIG. 5A is a graph showing a return loss of the antenna before the gap filling part is generated.
Figure 5B:
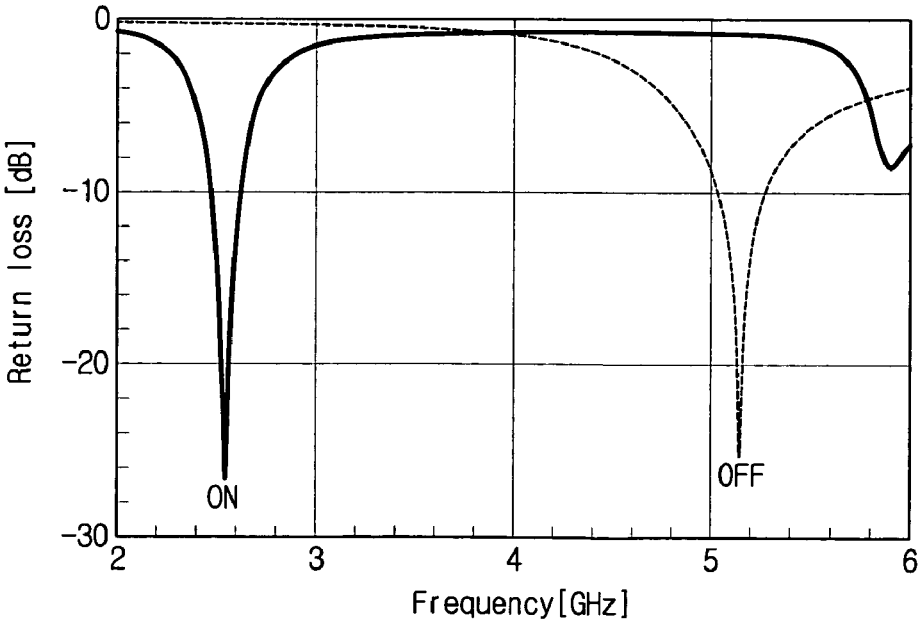
FIG. 5B is a graph showing a return loss of the antenna after the gap filling part is generated.

FIGS. 5A and 5B show graphs of the resonant frequency at 2.5 GHz and 5.2 GHz when the PIN diode 20 is turned on and off, respectively. FIGS. 5A and 5B compare the presence and absence of the parasitic operating frequency before and after the gap filling part 25 is generated. Note that the operating frequency generated according to on and off of the PIN diode 20 can be changed based on the length of the radiator 10 and the design of the position of the PIN diode 20. Accordingly, those having ordinary skill in the art will appreciate that scope of the present invention is not limited to any particular frequencies.

With the radiator 10 generated in the meander line, the antenna 1 can drastically reduce its size. The related art antenna is tens to hundreds of mm, whereas the antenna 1 in this particular embodiment is 10.3*8 $mm^2$ in size. Additionally, the assembly of the antenna 1 is facilitated because the radiator 10 is mounted on the circuit board 60 as the patch antenna 1.

As shown in FIGS. 1-3, the PIN diode 20 may be mounted on one side of the meander line part 15 along the longitudinal direction to electrically short or open the meander lines connected to both ends of the PIN diode 20.

In one embodiment, the PIN diode 20 may be turned on when voltage above a certain level is applied. In one embodiment, when the voltage above 1V is applied, the series resistance by the intrinsic region is 1Ω and the PIN diode 20 is turned on. Thus, the meander line connected by the PIN diode 20 is short-circuited and the length of the radiator 10 is equal to the summation of lengths of the feed part 11 and the meander line part 15.

Note that the total length of the radiator 10 can vary according to the design and the operating frequency of the antenna 1. The operating frequency is determined by the length of the radiator 10. For example, if the total length of the radiator 10 ranging from the feed part 11 and the meander line part 15 is 56.5 mm, the antenna 1 has the resonance point in the frequency band of 2.4 GHz. Since 2.4 GHz belongs to the frequency bands of IEEE 802.11b standard and Bluetooth, the antenna 1 can be used for both WLAN and Bluetooth. When the total length of the radiator 10 is more extended, the antenna 1 is applicable for WiBro services using 2.5 GHz frequency band.

When no voltage is applied to the PIN diode 20, the series resistance is 10 kΩ and the PIN diode 20 is turned off. Accordingly, the PIN diode 20 opens part of the meander line part 15 and the length of the radiator 10 is equal to the length from the feed part 11 and to the meander line before the PIN diode 20. The length from the feed part 11 to the meander line before the PIN diode 20 may vary according to the design. For example, when the length from the feed part 11 to the meander line before the PIN diode 20 is 14.65 mm, the antenna 1 has the resonance point of 5.3 GHz. Resonating in the frequency band of 5.3 GHz, the antenna 1 can be used as the antenna of IEEE 802.11a standard.

As such, when the PIN diode 20 is turned off and the length of the radiator 10 is extended, the antenna 1 has the relatively low resonance point. When the PIN diode 20 is turned off, the length of the radiator 10 is shortened and the antenna 1 has the relatively high resonance point. Hence, depending on whether the PIN diode is turned on or off, signals in two different service bands can be transmitted and received via the single antenna 1.

In one embodiment, a voltage of 5 V, which is generally used for a wireless terminal, is applied in the on state of the PIN diode 20. Thus, without a separate voltage supply source, cost effectiveness and the simplified circuitry can be achieved.

The switch controller 30, which turns the PIN diode 20 on and off, may be mounted in one side of the circuit board 60 of the ground 50, with both ends adjacent to the match part 51 along the longitudinal direction of the ground 50. The switch controller 30 applies the voltage of 0V or 5V to the PIN diode 20. When the switch controller 30 applies the voltage of 0V, the PIN diode 20 is turned off. When 5V is applied, the PIN diode 20 is turned on. The switch controller 30 may be implemented using a RLC circuit.

Figure 6A:
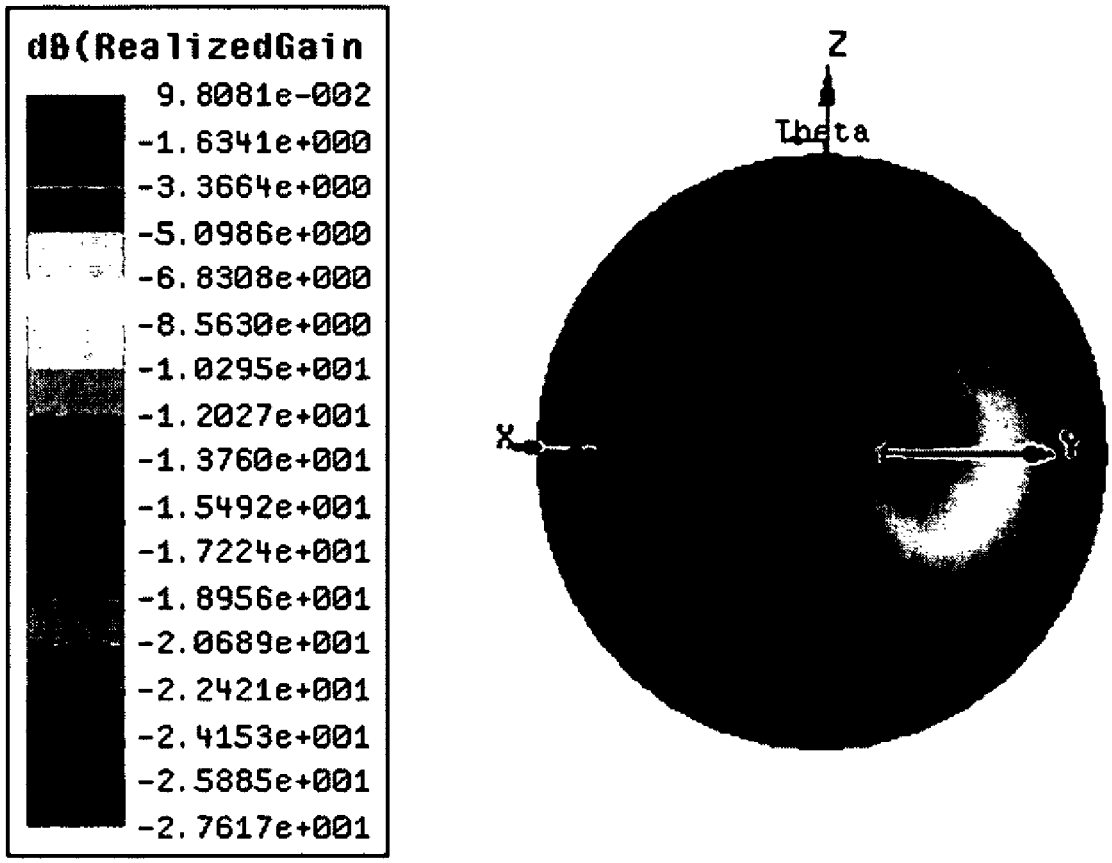
Figure 6B:
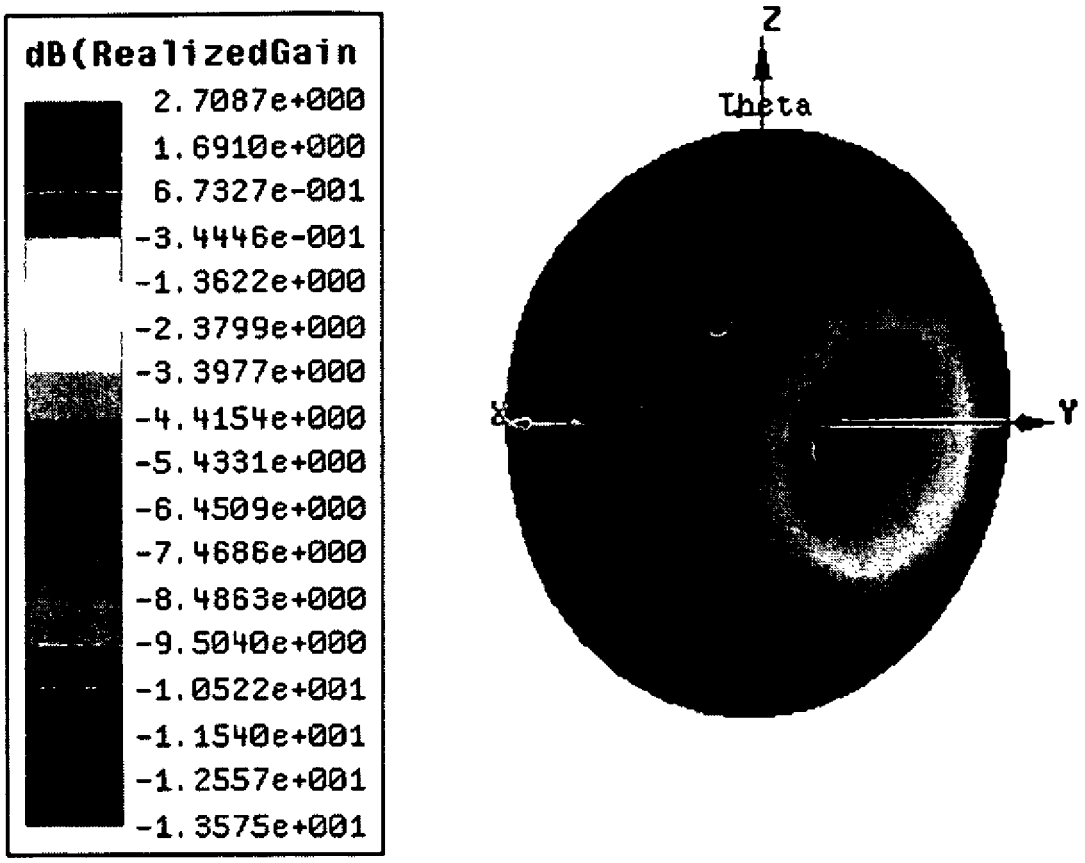
FIG. 6B shows a radiation pattern of the antenna when the PID diode is turned off.

FIG. 6A shows a radiation pattern of the antenna 1 when the PID diode 20 is turned on, and FIG. 6B shows a radiation pattern of the antenna 1 when the PID diode 20 is turned off.

With the PIN diode 20 turned on, the omnidirectional radiation pattern is defined. At this time, the gain of the antenna 1 is 0 dB. When the PIN diode 20 is turned off, the radiation pattern has the omnidirectionality and the gain of the antenna 1 is 2 dB. Therefore, the antenna 1 obtains not only the omnidirectionality but also the high gain in accordance with the properties of the dipole antenna.

The antenna 1 can significantly reduce the antenna size by shaping the radiator 10 as the meander line. Also, the antenna efficiency can be enhanced by eliminating the coupling from the meander line part 15 by virtue of the gap filling part 25.

The antenna 1 can execute the macro-tuning between the service bands using the PIN diode 20. Since it is possible to assemble a wireless terminal for receiving signals of the multiple frequency bands, the user convenience can be improved with the lowered cost. Also, the assembly of the antenna 1 is facilitated by mounting the radiator 10 on the circuit board 60.

In one exemplary embodiment of the present invention, the antenna 1 is designed to operate in the double frequency bands by loading only one PIN diode 20 on the radiator 10. It should be appreciated that the antenna 1 can be designed to operate in the multiband when a plurality of PIN diodes 20 is loaded.

As set forth above, the antenna size can be significantly reduced. Furthermore, the antenna efficiency can be enhanced by eliminating the coupling between the meander lines.

While the present invention has been particularly shown and described with reference to exemplary embodiments thereof, it will be understood by those skilled in the art that various changes in form and details may be made therein without departing from the spirit and scope of the invention as defined by the appended claims.

What is claimed is:

1. A multiband antenna with removed coupling, comprising:

a radiator, wherein the radiator is formed as a meander line, comprising a plurality of meander sub-lines, bent zigzag several times, and comprises a gap filling part in at least one area between neighboring meander sub-lines of the meander line, the gap filling part interconnecting the neighboring meander sub-lines;

a ground connected with the radiator; and at least one switch element mounted in an area along the longitudinal direction of the radiator and configured to alternately short and open an area of the radiator, so that the area in which the gap filling part is formed is distinguished from other areas of the radiator, wherein the gap filling part fills up gaps between the meander sub-lines, excluding a gap between the meander sub-lines where the switch element is mounted.

2. The multiband antenna with removed coupling of claim 1, wherein the switch element is a PIN diode.

3. The multiband antenna with removed coupling of claim 1, further comprising:

a switch controller configured to turn on the switch element by applying a voltage above a certain level to the switch element.

4. The multiband antenna with removed coupling of claim 1, wherein, when the switch element is turned on, the radiator operates in a lower frequency band than when the switch element is turned off.

5. The multiband antenna with removed coupling of claim 1, wherein a plurality of switch elements is loaded at intervals along the longitudinal direction of the radiator.

6. A multiband antenna with removed coupling, comprising:

a radiator, wherein the radiator is formed as a meander line, comprising a plurality of meander sub-lines, bent zigzag several times, and comprises a gap filling part in at least one area between neighboring meander sub-lines of the meander line, the gap filling part interconnecting the neighboring meander sub-lines;

a ground connected with the radiator; and at least one switch element mounted in an area along the longitudinal direction of the radiator and configured to alternately short and open an area of the radiator, so that the area in which the gap filling part is formed is distinguished from other areas of the radiator, wherein a length of the gap filling part in a first direction which is perpendicular to a direction of interconnecting the neighboring meander sub-lines is shorter than half of a length of one meander sub-line of the neighboring meander sub-lines in the first direction.

7. The multiband antenna with removed coupling of claim 6, wherein the switch element is a PIN diode.

8. The multiband antenna with removed coupling of claim 6, further comprising:

a switch controller configured to turn on the switch element by applying a voltage above a certain level to the switch element.

9. The multiband antenna with removed coupling of claim 6, wherein, when the switch element is turned on, the radiator operates in a lower frequency band than when the switch element is turned off.

10. The multiband antenna with removed coupling of claim 6, wherein a plurality of switch elements is loaded at intervals along the longitudinal direction of the radiator.

11. A multiband antenna with removed coupling, comprising:

a radiator, wherein the radiator is formed as a meander line, comprising a plurality of meander sub-lines, bent zigzag several times, and comprises a gap filling part in at least one area between neighboring meander sub-lines of the meander line, the gap filling part interconnecting the neighboring meander sub-lines;

a ground connected with the radiator; and at least one switch element mounted in an area along the longitudinal direction of the radiator and configured to alternately short and open an area of the radiator, so that the area in which the gap filling part is formed is distinguished from other areas of the radiator, wherein all neighboring meander sub-lines are interconnected by the gap filling part except a gap between two neighboring sub-lines where the switch element is mounted, and wherein the switch element is dedicated to adjust an operating frequency of the multiband antenna, and the gap filling part is dedicated to reduce parasitic frequencies with respect to the operating frequency.

12. The multiband antenna with removed coupling of claim 11, wherein the switch element is a PIN diode.

13. The multiband antenna with removed coupling of claim 11, further comprising:

a switch controller configured to turn on the switch element by applying a voltage above a certain level to the switch element.

14. The multiband antenna with removed coupling of claim 11 wherein, when the switch element is turned on, the radiator operates in a lower frequency band than when the switch element is turned off.

15. The multiband antenna with removed coupling of claim 11, wherein a plurality of switch elements is loaded at intervals along the longitudinal direction of the radiator.

16. A multiband antenna with removed coupling, comprising:

a radiator, wherein the radiator is formed as a meander line, comprising a plurality of meander sub-lines, bent zigzag several times, and comprises a gap filling part in at least one area between neighboring meander sub-lines of the meander line, the gap filling part interconnecting the neighboring meander sub-lines;

a ground connected with the radiator; and at least one switch element mounted in an area along the longitudinal direction of the radiator and configured to alternately short and open an area of the radiator, so that the area in which the gap filling part is formed is distinguished from other areas of the radiator, wherein the at least one area corresponds to approximately a half of an entire area of a gap between the neighboring meander sub-lines, but less than the half of the entire area of the gap, and the at least one area is disposed on an side of a bent part of the meander line.

17. The multiband antenna with removed coupling of claim 16, wherein the switch element is a PIN diode.

18. The multiband antenna with removed coupling of claim 16, further comprising:

a switch controller configured to turn on the switch element by applying a voltage above a certain level to the switch element.

19. The multiband antenna with removed coupling of claim 16, wherein, when the switch element is turned on, the radiator operates in a lower frequency band than when the switch element is turned off.

20. The multiband antenna with removed coupling of claim 16, wherein a plurality of switch elements is loaded at intervals along the longitudinal direction of the radiator.

* * * * *